US012497763B2

(12) United States Patent
Serrurier et al.

(10) Patent No.: US 12,497,763 B2
(45) Date of Patent: Dec. 16, 2025

(54) HOLDER FOR A WORK TOOL

(71) Applicant: Caterpillar Inc., Peoria, IL (US)

(72) Inventors: Douglas Charles Serrurier, Morton, IL (US); Andrew W. Young, Braunfels, TX (US); Eric Thomas Sinn, Tremont, IL (US)

(73) Assignee: Caterpillar Inc., Peoria, IL (US)

( * ) Notice: Subject to any disclaimer, the term of this patent is extended or adjusted under 35 U.S.C. 154(b) by 846 days.

(21) Appl. No.: 17/804,439

(22) Filed: May 27, 2022

(65) Prior Publication Data

US 2023/0383502 A1 Nov. 30, 2023

(51) Int. Cl.
*E02F 9/28* (2006.01)

(52) U.S. Cl.
CPC ..... *E02F 9/2825* (2013.01); *E02F 9/2833* (2013.01)

(58) Field of Classification Search
CPC ..... E02F 3/40; E02F 9/2825; E02F 9/2833; E02F 9/2841; E02F 9/2808; E02F 9/2883
See application file for complete search history.

(56) References Cited

U.S. PATENT DOCUMENTS

| | | | | |
|---|---|---|---|---|
| 5,452,529 | A | 9/1995 | Neuenfeldt et al. | |
| 6,145,224 | A | 11/2000 | Stickling | |
| 7,219,454 | B2 * | 5/2007 | Maher | E02F 9/2833 37/456 |
| 9,540,796 | B2 * | 1/2017 | Dallard | E02F 9/2841 |
| 9,632,200 | B2 | 4/2017 | Tasovski | |
| 9,909,285 | B2 * | 3/2018 | Bjerke | E02F 3/40 |
| 9,938,695 | B2 | 4/2018 | Bjerke et al. | |
| 10,947,704 | B2 | 3/2021 | Bjerke | |
| 2020/0141093 | A1 | 5/2020 | Bjerke et al. | |
| 2021/0230845 | A1 | 7/2021 | Bjerke | |

* cited by examiner

*Primary Examiner* — Joseph M Rocca
*Assistant Examiner* — Robert E Pezzuto

(57) ABSTRACT

A shroud retention system may include a retainer plate holder having a top surface, a bottom surface parallel to the top surface, a retainer plate engaging surface extending between the bottom surface and the top surface, wherein the retainer plate engaging surface may be inclined relative to a plane perpendicular to the top surface, a rear surface opposite the retainer plate engaging surface, a through-hole intersecting the retainer plate engaging surface and the rear surface and one or more protrusions extending from the retainer plate engaging surface.

20 Claims, 16 Drawing Sheets

HOLDER FOR A WORK TOOL

TECHNICAL FIELD

The present disclosure relates generally to a holder for a work tool, and more particularly, to a holder for use with a shroud retention system of a work tool.

BACKGROUND

Earth-working machines, such as excavators, shovels, and wheel loaders, include ground engaging work tools that engage with and/or move a variety of earthen materials. These work tools often have one or more cutting tools or tooth assemblies mounted to an edge of the work tool, for example, to a lip of a bucket. The exposed portions of the work tool edge between adjacent tooth assemblies come into contact with the ground or the earthen materials and are subjected to extreme abrasion and impacts that cause them to wear. To prolong the useful life of the work tools, wear members or shrouds are attached to the work tools between adjacent tooth assemblies to protect the exposed portions of the work tool edge.

Although the wear members protect the edge of the work tool, the wear members are still subject to severe abrasion and may need periodic repair or replacement. Removal and/or replacement of a wear member may require disassembly of the wear members from the edge of the work tool, and assembly of a repaired or a new wear member on the work tool. The machine must be taken out of service to perform such replacement or repair. The time required to disassemble and reassemble a wear member may be dictated by the mechanism used to retain the wear member on the work tool. It is desirable to have a retention system that allows for quick assembly and disassembly at a worksite to allow the machine to be returned to service as quickly as possible.

U.S. Pat. No. 9,938,695 to Bjerke, issued on Apr. 10, 2018 ("the '695 patent"), describes a shroud retention system directed to addressing the speed and ease of the aforementioned assembly and disassembly. The shroud retention system of the '695 patent includes a retainer plate that can be locked into place within a channel of a shroud to hold the shroud in position on a work tool. In some circumstances and/or under certain loads, however, the retainer plate may be inadvertently moved into an unlocked position and cease to hold the shroud on the work tool. Accordingly, a need exists to secure the retainer plate of the shroud retention system.

The system of the present disclosure may solve one or more of the problems set forth above and/or other problems in the art. The scope of the current disclosure, however, is defined by the attached claims, and not by the ability to solve any specific problem.

SUMMARY

In one aspect, a shroud retention system may include a retainer plate holder having a top surface, a bottom surface parallel to the top surface, a retainer plate engaging surface extending between the bottom surface and the top surface, wherein the retainer plate engaging surface may be inclined relative to a plane perpendicular to the top surface, a rear surface opposite the retainer plate engaging surface, a through-hole intersecting the retainer plate engaging surface and the rear surface and one or more protrusions extending from the retainer plate engaging surface.

In another aspect, a shroud retention system may include a retainer plate holder having a top surface, a bottom surface parallel to the top surface, a retainer plate engaging surface extending from the bottom surface to the top surface, wherein the retainer plate engaging surface may be inclined relative to a plane perpendicular to the top surface, and a rear surface opposite the retainer plate engaging surface, wherein upon application of a force against the rear surface, the retainer plate engaging surface may be configured to engage with a retainer plate and inhibit movement of the retainer plate through a plane parallel with the retainer plate engaging surface.

In still another aspect, a shroud retention system may include a compressor block including a compressor front surface, a compressor rear surface opposite the compressor front surface, and a hole extending into the compressor block from the compressor rear surface, wherein the compressor rear surface may be inclined relative to the compressor front surface, a retainer plate including a retainer front surface, a retainer rear surface opposite and substantially parallel to the retainer front surface, and a first through-hole extending from the retainer front surface to the retainer rear surface, wherein the retainer plate may be positioned such that the retainer front surface engages with the compressor rear surface, a retainer plate holder including a retainer plate engaging surface, a rear surface opposite the retainer plate engaging surface, and a second through-hole extending from the retainer plate engaging surface to the rear surface, wherein the retainer plate engaging surface may be inclined relative to the rear surface, and a bolt extending through the first through-hole and second through-hole and secured within the compressor block, wherein a compressive force applied by the bolt may cause the retainer plate engaging surface to engage with a retainer plate and inhibit movement of the retainer plate through a plane parallel with the retainer plate engaging surface.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
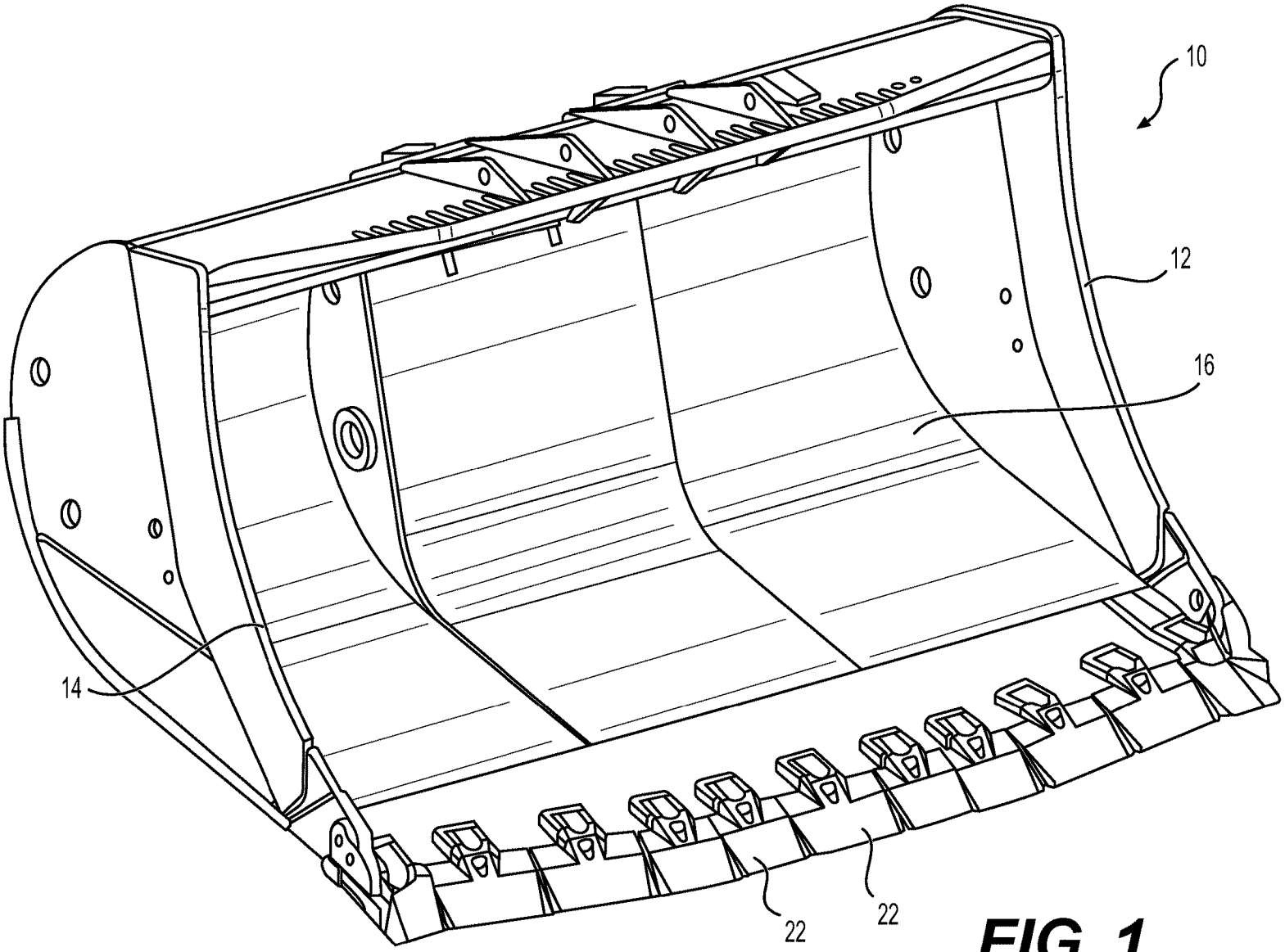
FIG. 1 is an illustration of an exemplary work tool, according to aspects of the disclosure.

FIG. 1 illustrates an exemplary work tool 10 for a machine (not shown). Work tool 10 may embody any device used to perform a task assigned to the machine. For example, work tool 10 may be a bucket (shown in FIG. 1), a blade, a shovel, a crusher, a grapple, a ripper, or any other material moving device known in the art. Work tool 10 may include side walls 12, 14, and primary wall 16, which may form a bottom of work tool 10. Primary wall 16 may extend from side wall 12 to side wall 14. Primary wall 16 of work tool 10 may also include edge 18 (see FIG. 2), extending between side walls 12, 14. Edge 18 may be detachable from work tool 10 or it may be a fixed component of work tool 10.

Work tool 10 may include a plurality of shrouds 22 (or wear members) attached to edge 18. Each shroud 22 may be configured to protect edge 18 from abrasion and wear by reducing or preventing contact of an exposed portion of edge 18 with earthen materials. In some exemplary embodiments, shrouds 22 may be disposed between adjacent tool assemblies (not shown) attached to edge 18 to protect a portion of edge 18 between the adjacent tool assemblies from abrasion and wear.

For the purposes of this disclosure, attention will be focused on a manner of attaching and securing shrouds 22 to work tool 10. It is contemplated, however, that the attachment methods and structures presented in this disclosure may be equally utilized with tool assemblies (e.g., wear tooth assemblies), other wear components, and/or with any other wear components known in the art.

Figure 2:
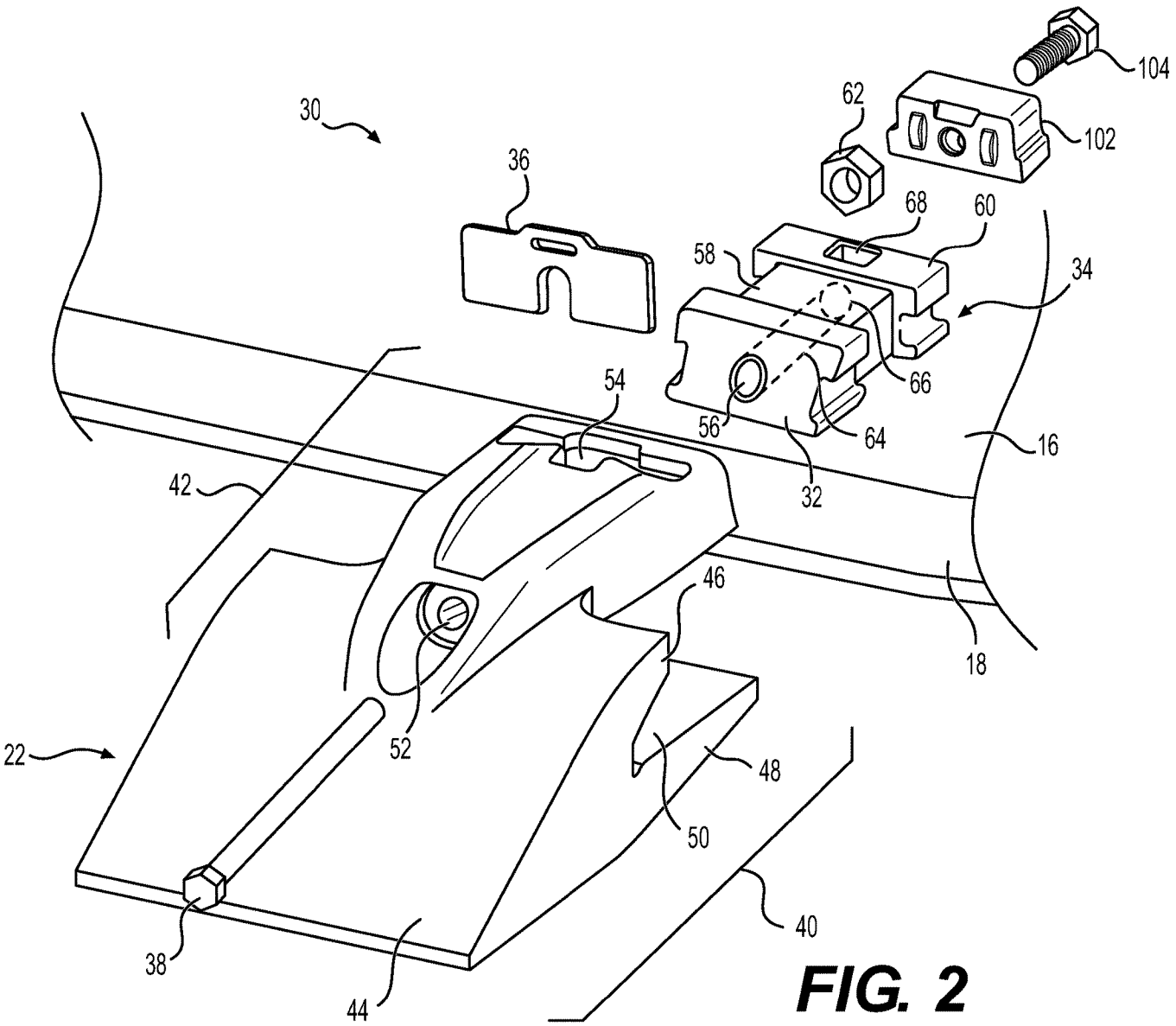
FIG. 2 is an exploded view of exemplary shroud retention system for the work tool of FIG. 1.

FIG. 2 illustrates an exemplary shroud retention system 30 for attaching shroud 22 to work tool 10. Shroud retention system 30 may include adapter 32, spring assembly 34, retainer plate 36, and bolt 38. Shroud 22 may include tip portion 40 and attachment portion 42. Tip portion 40 may be generally U-shaped and may include tip 44, upper leg 46, and lower leg 48. Upper and lower legs 46, 48 may extend in a direction away from tip 44. Upper and lower legs 46, 48 may be spaced apart from each other to form opening 50 that may be large enough to receive edge 18 of work tool 10. Attachment portion 42 may be attached to upper leg 46 of tip portion 40. Like upper and lower legs 46, 48, attachment portion 42 may extend in a direction away from tip 44. Attachment portion 42 may include hole 52 configured to receive bolt 38. Attachment portion 42 may also include opening 54 configured to slidably receive retainer plate 36.

Adapter 32 may be attached to primary wall 16 of work tool 10. Adapter 32 may be configured to be slidably received in attachment portion 42. Adapter 32 may include hole 56 configured to receive bolt 38. Spring assembly 34 may be disposed adjacent adapter 32. Spring assembly 34 may be attached to adapter 32, but not attached to primary wall 16, and may include spring damper 58, slide compressor 60, and nut 62. As illustrated in FIG. 2, spring damper 58 may be disposed between adapter 32 and slide compressor 60. Spring damper 58 may include hole 64 configured to receive bolt 38. Slide compressor 60 may be configured to be slidably received in attachment portion 42. Slide compressor 60 may include hole 66 configured to receive bolt 38. Slide compressor 60 may also include slot 68, which may be configured to receive nut 62. Bolt 38 may pass through hole 52 in attachment portion 42 of shroud 22, hole 56 in adapter 32, hole 64 in spring damper 58, and hole 66 in slide compressor 60 to engage with threads of nut 62 disposed within slot 68. Slide compressor 60 may be configured to slidably movable relative to adapter 32. For example, slide compressor 60 may be configured to slidably move towards adapter 32 when bolt 38 is turned to engage with nut 62, compressing spring damper 58 disposed between adapter 32 and slide compressor 60.

Figure 3:
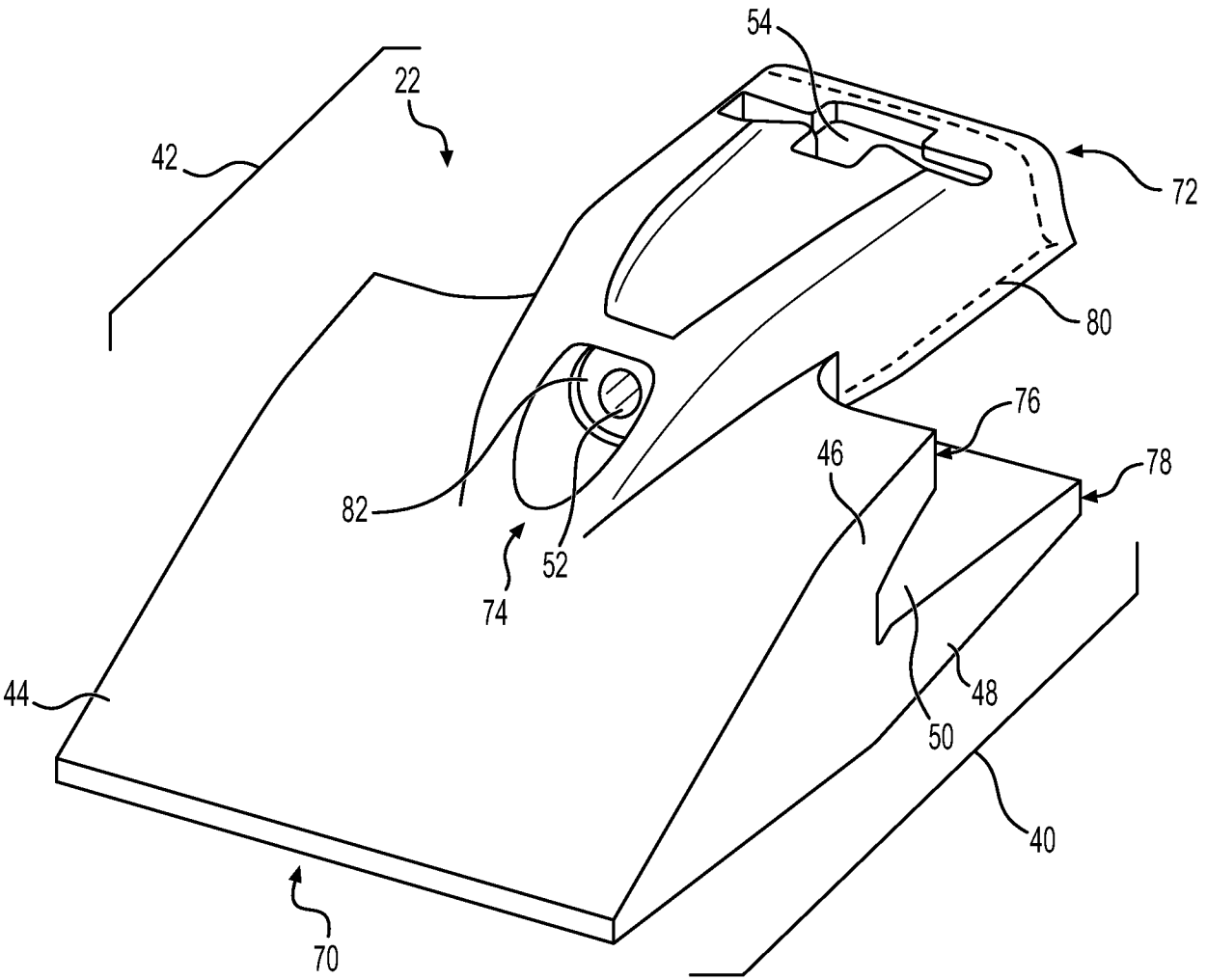
FIG. 3 is a perspective view of an exemplary shroud of the shroud retention system of FIG. 2.

FIG. 3 illustrates a perspective view of shroud 22, which may extend from adjacent shroud proximal end 70 to adjacent shroud distal end 72. Tip 44 of shroud 22 may extend from adjacent shroud proximal end 70 to adjacent tip end 74. Tip 44 may be generally wedge shaped with a thickness adjacent shroud proximal end 70, which may be smaller than a thickness of tip 44 adjacent tip end 74. Upper leg 46 of tip portion 40 may extend from tip end 74 to upper leg distal end 76, which may be disposed between tip end 74 and shroud distal end 72. Lower leg 48 of tip portion 40 may extend from tip end 74 to lower leg distal end 78, which may be disposed between tip end 74 and shroud distal end 72. Upper leg 46 may be spaced apart from lower leg 48, forming opening 50 between upper and lower legs 46, 48. Upper and lower legs 46, 48 may be wedge shaped. For example, a thickness of upper leg 46 adjacent tip end 74 may be larger than a thickness of upper leg 46 adjacent upper leg distal end 76. Likewise, a thickness of lower leg 48 adjacent tip end 74 may be larger than a thickness of lower leg 48 adjacent lower leg distal end 78.

Attachment portion 42 may be attached to tip portion 40. In one exemplary embodiment as illustrated in FIG. 3, attachment portion 42 may be attached to upper leg 46 and may extend from adjacent tip end 74 to shroud distal end 72. Attachment portion 42 may include a channel 80 (see dashed lines), which may extend from adjacent tip end 74 to shroud distal end 72. Channel 80 may be configured to slidably engage with adapter 32 and slide compressor 60. Attachment portion 42 may also include channel front wall 82 adjacent tip end 74. Channel front wall 82 may include hole 52, which may be a through hole. Hole 52 may be sized to receive bolt 38, which may pass through hole 52 and extend into channel 80. As also illustrated in FIG. 3, attachment portion 42 may include opening 54, which may be configured to receive retainer plate 36. Opening 54 may be disposed adjacent shroud distal end 72 across a width of attachment portion 42. In one exemplary embodiment as illustrated in FIG. 3, opening 54 may be disposed nearer to shroud distal end 72 compared to tip end 74. A width of opening 54 may be selected to allow retainer plate 36 to pass through opening 54 into channel 80.

Figure 4:
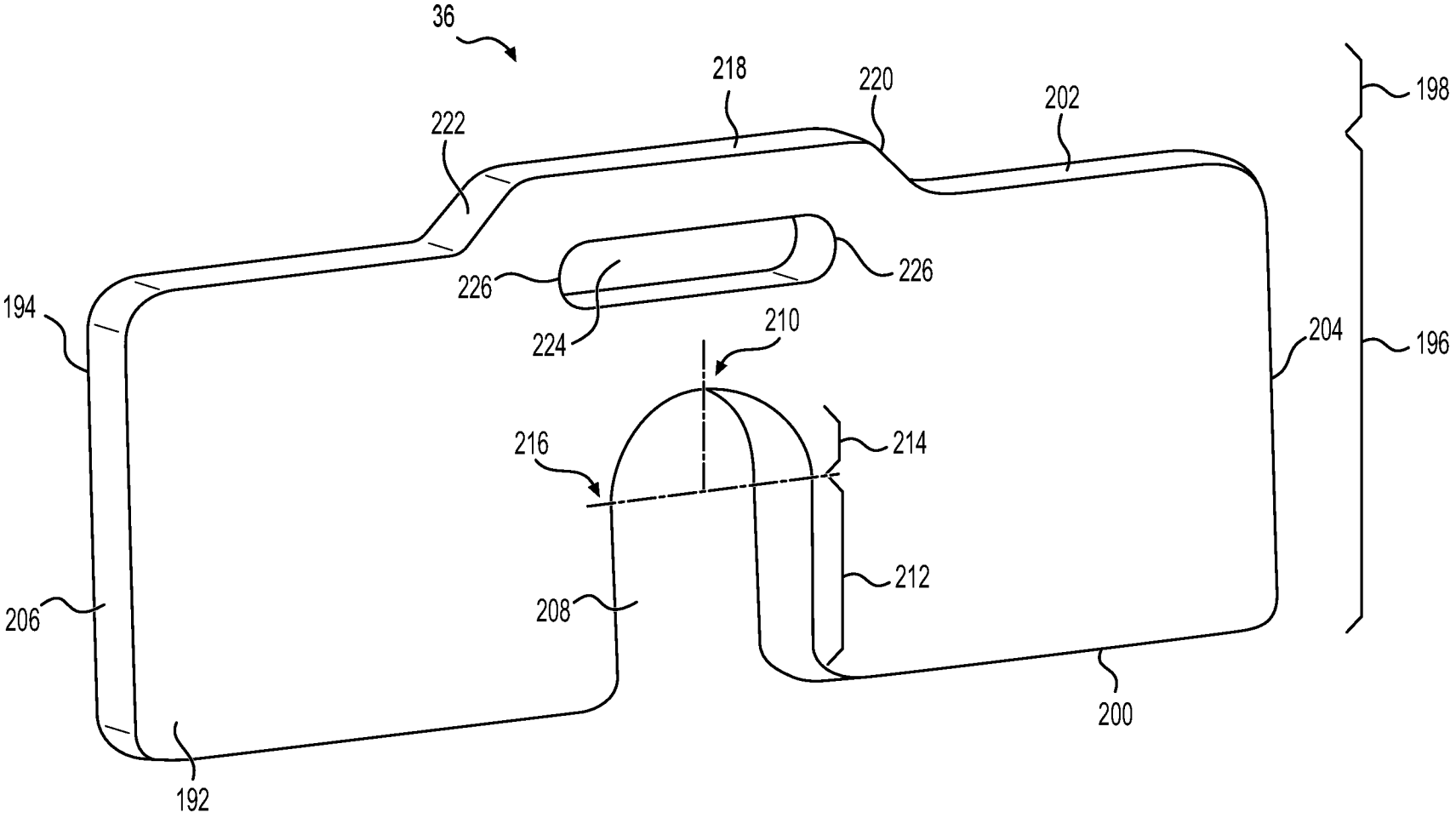
FIG. 4 is a perspective view of an exemplary retainer plate of the shroud retention system of FIG. 2.

FIG. 4 illustrates a perspective view of an exemplary retainer plate 36 according to some embodiments. Retainer plate 36 may have a retainer front surface 192 disposed opposite retainer rear surface 194. Retainer plate 36 may include retainer portion 196 and pull out portion 198. Retainer portion 196 may have a generally rectangular shape and may include retainer bottom surface 200, retainer top surface 202, first retainer side surface 204, and second retainer side surface 206. Retainer bottom surface 200 may extend from retainer front surface 192 to retainer rear surface 194. Retainer bottom surface 200 may be disposed generally orthogonal to retainer front and rear surfaces 192, 194. Retainer top surface 202 may extend from retainer front surface 192 to retainer rear surface 194. Retainer top surface 202 may be disposed generally orthogonal to retainer front and rear surfaces 192, 194. First retainer side surface 204 may extend from retainer front surface 192 to retainer rear surface 194 and between retainer bottom surface 200 and retainer top surface 202. First retainer side surface 204 may be disposed generally orthogonal to retainer front and retainer rear surfaces 192, 194 and retainer top and bottom surfaces 200, 202. Likewise, second retainer side surface 206 may extend from retainer front surface 192 to retainer rear surface 194 and extend between retainer bottom surface 200 and retainer top surface 202. Second retainer side surface 206 may be disposed generally orthogonal to retainer front and retainer rear surfaces 192, 194 and retainer top and bottom surfaces 200, 202. It is contemplated, however, that retainer front surface 192, retainer rear surface 194, retainer bottom surface 200, retainer top surface 202, first retainer side surface 204, and second retainer side surface 206 may be disposed generally inclined relative to one or more of each other.

Retainer portion 196 may include slot 208, which may extend from retainer front surface 192 to retainer rear surface 194. In some embodiments, slot 208 may be disposed generally midway between first and second retainer side surfaces 204, 206. Slot 208 may extend from retainer bottom surface 200 toward retainer top surface 202 to slot end 210, which may be disposed between retainer bottom surface 200 and retainer top surface 202. Slot 208 may include first slot portion 212 and second slot portion 214. First slot portion 212 may extend from retainer bottom surface 200 to first slot portion end 216, which may be disposed between retainer bottom surface 200 and slot end 210. First slot portion 212 may be a generally rectangular slot. It is contemplated, however, that first slot portion 212 may have a square shape or any other suitable shape known in the art. Second slot portion 214 may extend from first slot portion end 216 to slot end 210. Second slot portion 214 may have a generally semi-circular shape.

Pull out portion 198 may have a generally trapezoidal shape and may extend outward from retainer top surface 202 of retainer portion 196. Pull out portion 198 may be disposed generally midway between first and second retainer side surfaces 204, 206 of retainer portion 196. Pull out portion 198 may have a top wall 218, which may extend between retainer front surface 192 and retainer rear surface 194 of retainer plate 36. Top wall 218 may be disposed generally parallel to retainer top surface 202 of retainer portion 196. Top wall 218 may be disposed above retainer top surface 202.

Pull out portion 198 may have first side wall 220 and second side wall 222 disposed opposite first side wall 220. First and second side walls 220, 222 may extend from retainer front surface 192 to retainer rear surface 194 of retainer plate 36. First and second side walls 220, 222 may be disposed generally orthogonal to retainer front surface 192 and retainer rear surface 194 of retainer plate 36. First and second side walls 220, 222 may connect top wall 218 of pull out portion 198 with retainer top surface 202 of retainer portion 196. First and second side walls 220, 222 may be inclined relative to top wall 218 and retainer top surface 202 so that pull out portion 198 may have a generally trapezoidal shape.

Retainer plate 36 may include slot 224, which may be disposed between slot end 210 and top wall 218. Slot 224 may extend from retainer front surface 192 to retainer rear surface 194. Slot 224 may have a generally rectangular shape with generally semi-circular shaped slot ends 226. It is contemplated, however, that slot 224 may have an oblong, elliptical, circular, or any other type of shape known in the art. In some embodiments, slot 224 may be disposed generally orthogonal to slot 208. In some embodiments, slot 224 may be disposed partially in retainer portion 196 and partially in pull out portion 198. It is contemplated, however, that slot 224 may be disposed wholly in one of retainer portion 196 and pull out portion 198.

Figure 5:
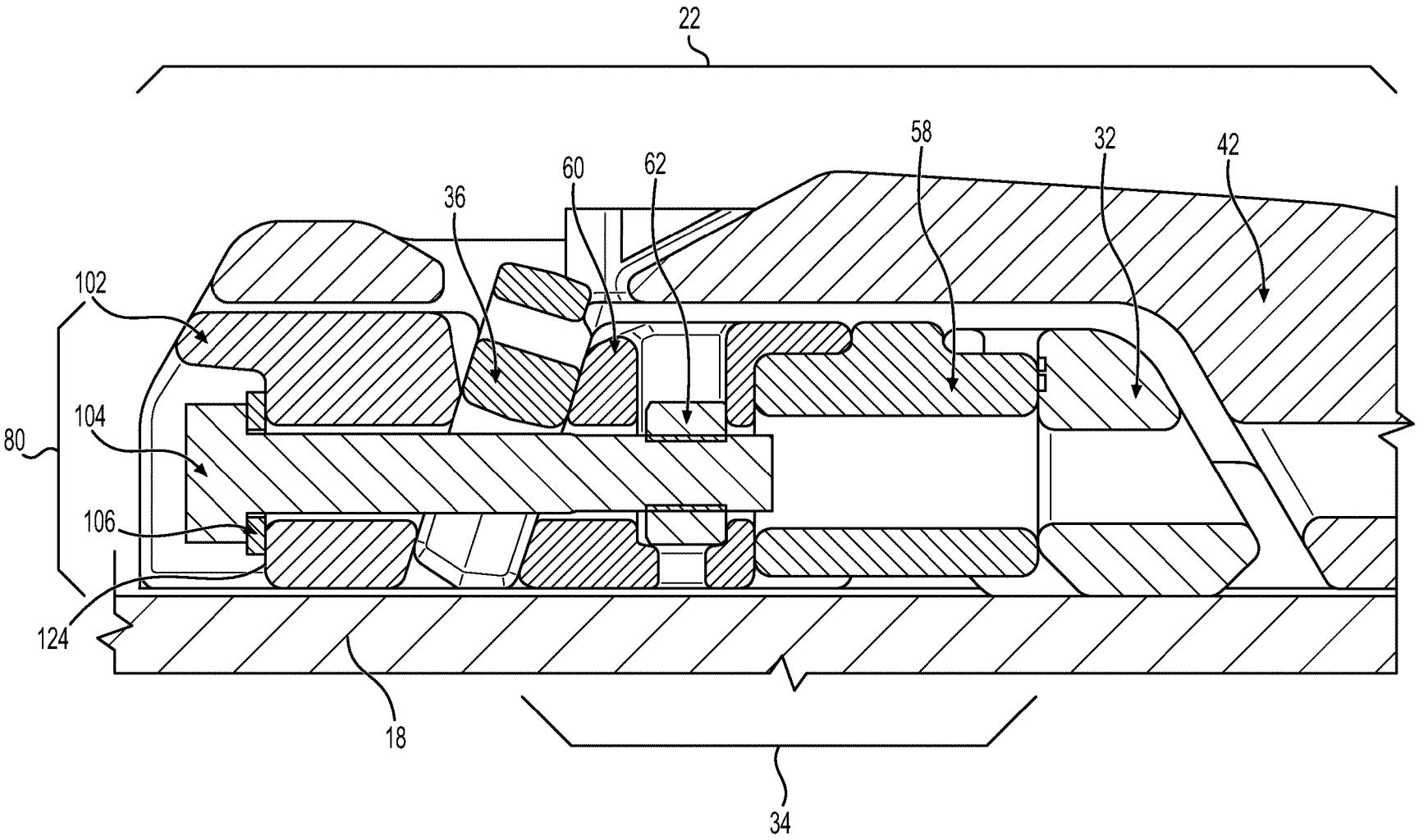
FIG. 5 is a cross-sectional side view of the shroud retention system of FIG. 2.

FIG. 5 illustrates a cross-sectional side view of an exemplary shroud retention system including a holder 102 in an assembled configuration. As shown in FIG. 5, shroud 22 may be attached to edge 18 of work tool 10 by the shroud retention system. Though not shown in FIG. 5, tip portion 40 may be oriented to the right of attachment portion 42. Adapter 32 may be disposed on an upper surface of edge 18. In some exemplary embodiments, adapter 32 may be fixedly attached to edge 18 via welded joints, fasteners, or using any other means of attachment known in the art. Adapter 32 may be disposed within channel 80 of attachment portion 42, such that adapter 32 slidably engages with channel 80.

Slide compressor 60 may also be disposed within channel 80 and may slidably engage with channel 80. As illustrated in FIG. 5, spring damper 58 may be disposed between adapter 32 and slide compressor 60 within channel 80. Nut 62 may be disposed within slide compressor 60. As also illustrated in FIG. 5, retainer plate 36 may be disposed within channel 80 in a locked position. During attachment of shroud 22 to the work tool, as will be described in greater detail hereinafter with reference to FIG. 13, slide compressor 60 may compress spring damper 58 against adapter 32 upon rotation of bolt 38 (shown in FIG. 2) within nut 62. While spring damper 58 is compressed, retainer plate 36 may be disposed in channel 80 such that retainer plate 36 abuts slide compressor 60. Retainer plate 36 may be positioned within channel 80 so that, when slide compressor 60 is released from compressing spring damper 58, retainer plate 36 may be forced by slide compressor 60 against internal surfaces of attachment portion 42. The forces exerted against internal surfaces of attachment portion 42 and corresponding friction forces may hold retainer plate 36 in the locked position, thereby preventing shroud 22 from moving relative to adapter 32 and consequently preventing shroud 22 from moving relative to the work tool. Bolt 38 may then be removed and holder 102 may be placed adjacent retainer plate 106. Holder 102 may then be fastened in place by inserting bolt 104 there through, engaging bolt 104 with nut 62, and rotating bolt 104 to tighten it against nut 62.

Figure 6:
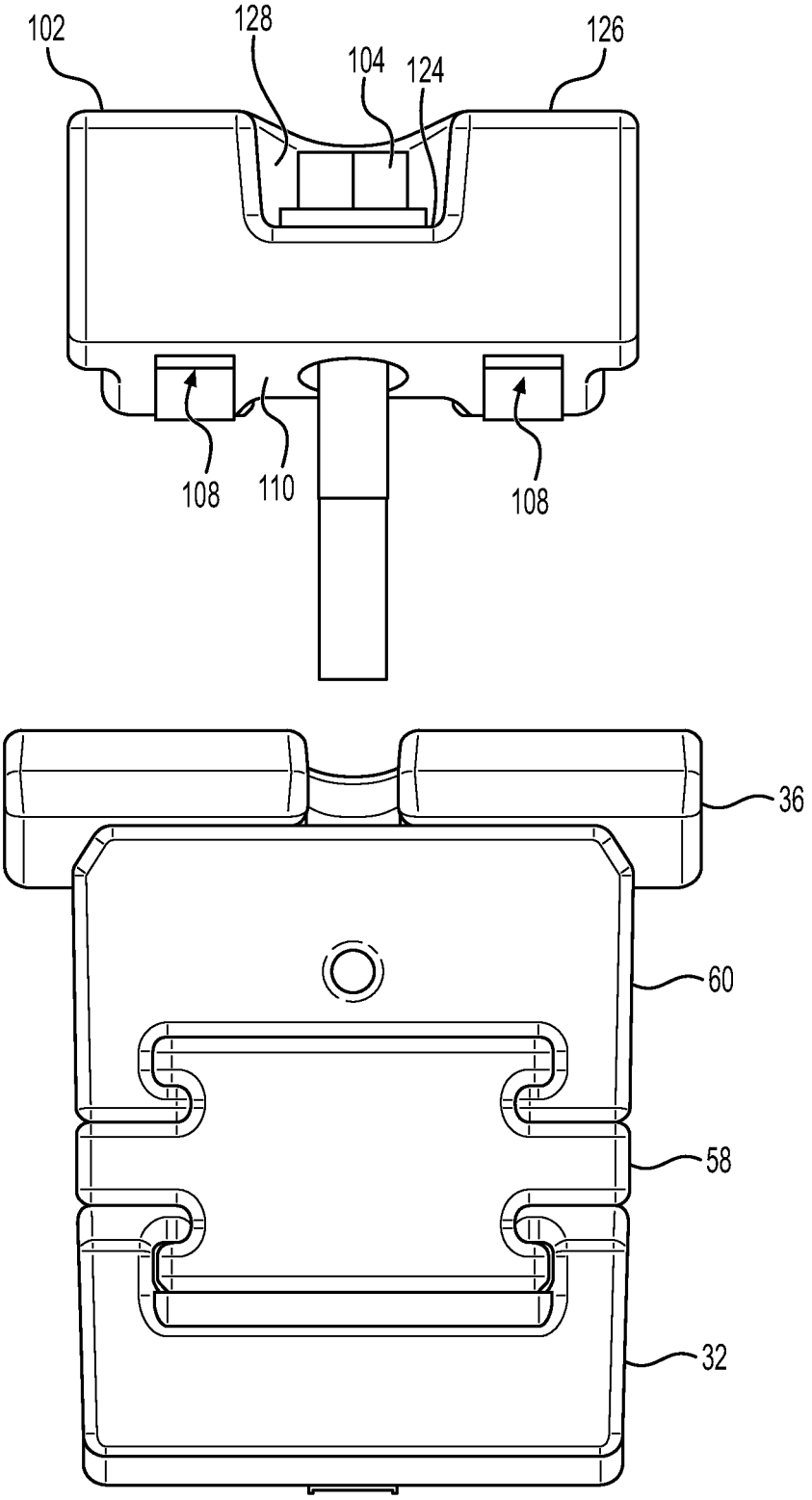
FIG. 6 is a bottom view of the shroud retention system of FIG. 2.
Figure 8:
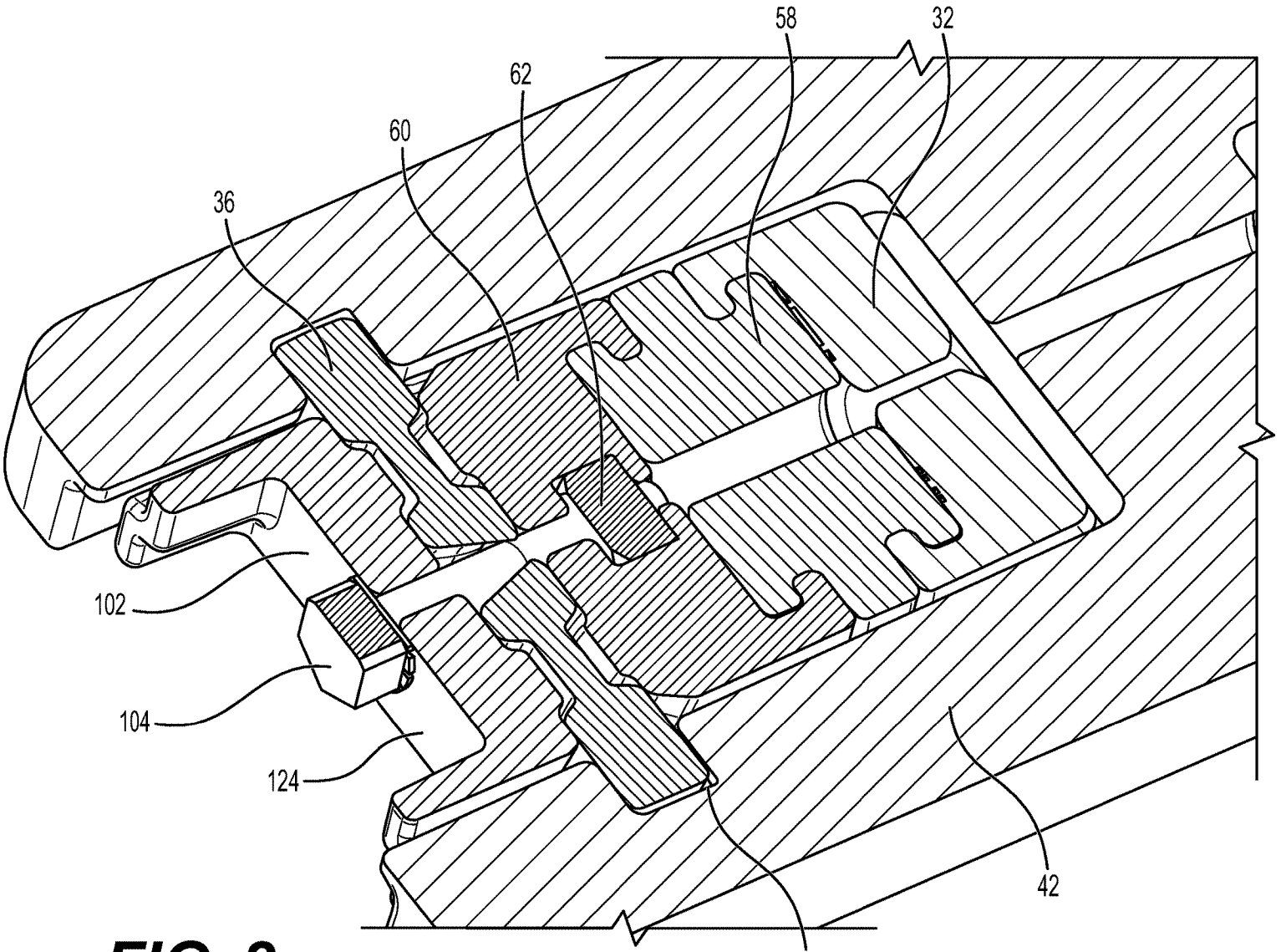
FIG. 8 is a cross-sectional perspective view of the shroud retention system of FIG. 2.

FIGS. 6 and 8 further illustrate the action of retainer plate 36 against internal surfaces of attachment portion 42. As shown, retainer plate 36 may have a greater lateral width than slide compressor 60. Attachment portion 42 may include an opening 54 corresponding to retainer plate 36 which is wider than adjacent portions of channel 80. Force exerted by slide compressor 60 against retainer plate 36 may therefore urge retainer plate 36 against internal surfaces of opening 54 to hold shroud 22 in place on the work tool.

Figure 7:
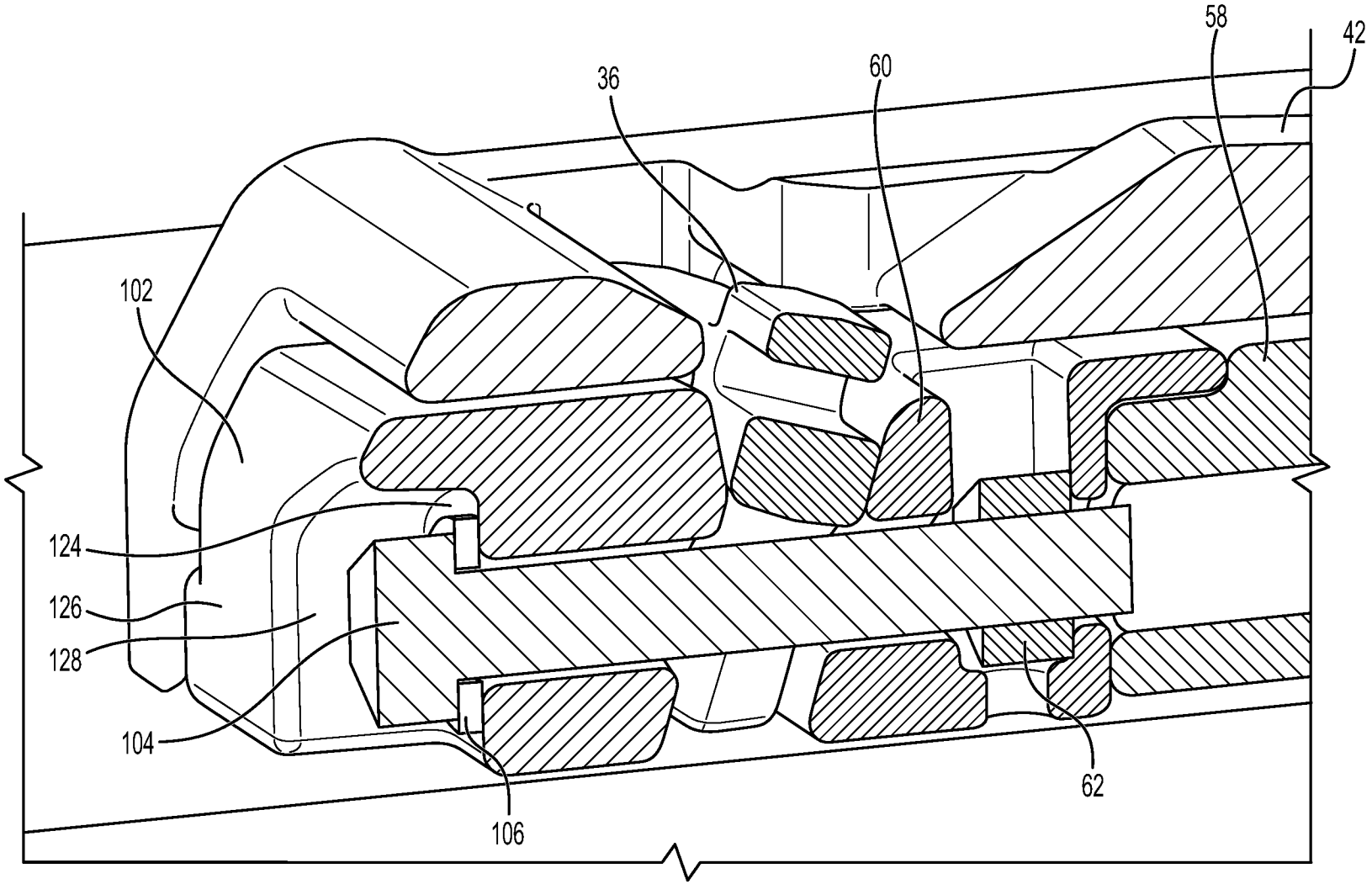
FIG. 7 is a cross-sectional perspective view of the shroud retention system of FIG. 2.

As shown in FIGS. 5, 7, and 8, to inhibit retainer plate 36 from moving out of position and consequently releasing shroud 22 from the work tool, holder 102 may be positioned within channel 80 and may abut retainer plate 36 opposite slide compressor 60. Holder 102 may be held in place by bolt 104 and washer 106. Bolt 104 may extend through each of holder 102, retainer plate 36, and slide compressor 60 to engage with nut 62, which secures bolt 104. Washer 106 may be positioned between a rear surface 124 of holder 102 and a head of washer 106 to distribute a load applied to holder 102 by bolt 104. When bolt 104 is tightened, holder 102 may exert a lateral force on retainer plate 36 thereby urging it against slide compressor 60. Friction between retainer plate 36 and slide compressor 60 and/or friction between retainer plate 36 and holder 102 may prevent retainer plate 36 from being displaced out of channel 80.

Figure 10B:
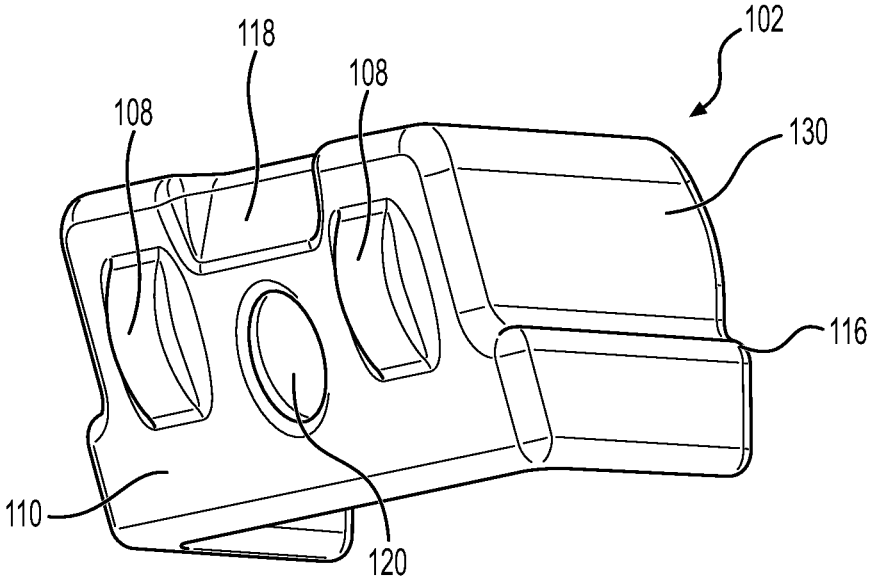
FIG. 10B is a front perspective view of the holder of FIG. 10A.
Figure 11A:
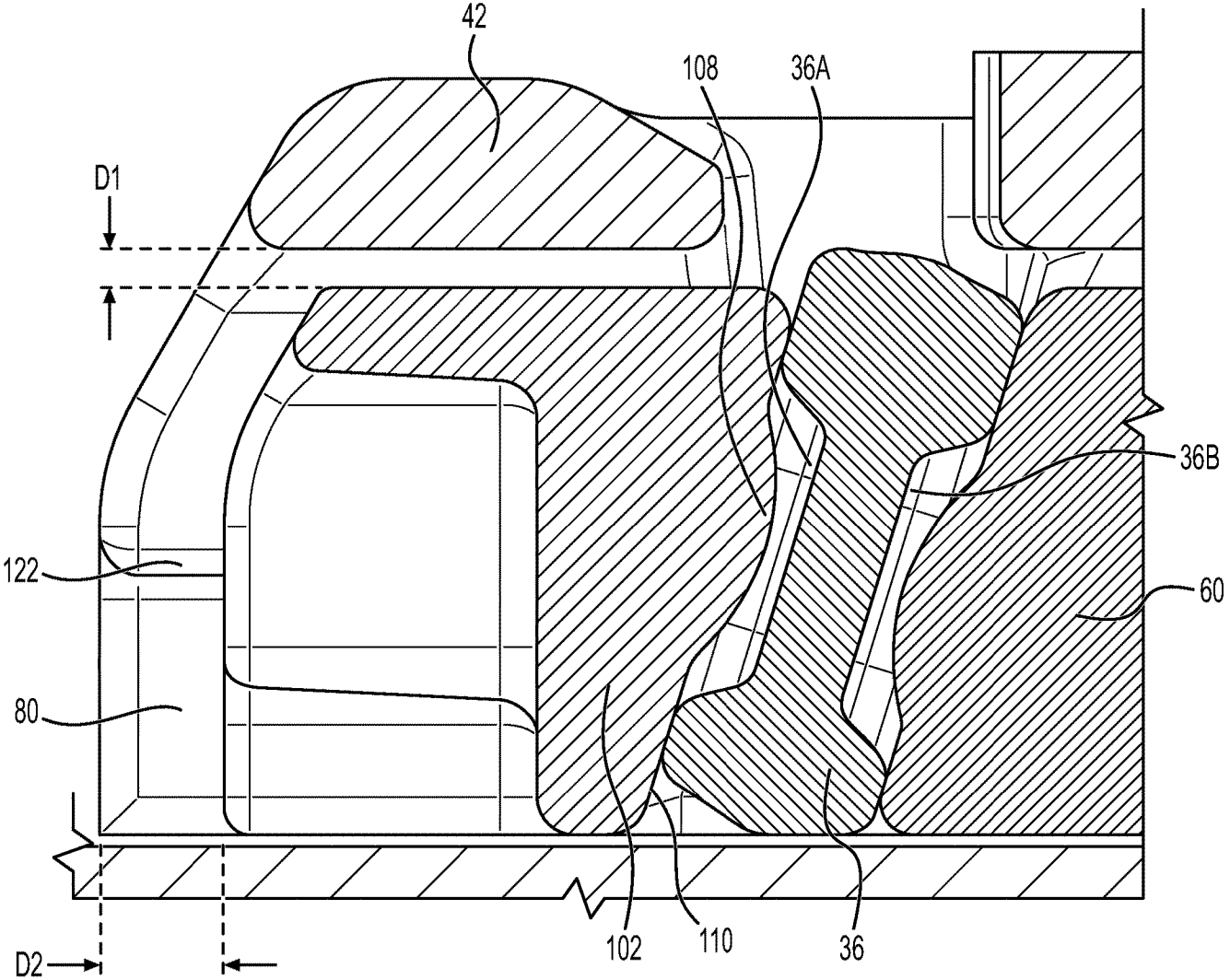
FIG. 11A is a cross-sectional side view of an exemplary embodiment of a shroud retention system.

As shown in FIGS. 5, 7, and 11A, holder 102 may include top and bottom surfaces that are generally parallel with corresponding interior surfaces of channel 80. As shown in FIGS. 6, 10B, and 11A, holder 102 may further include a retainer plate engaging surface 110. Retainer plate engaging surface 110 may be inclined relative to a plane perpendicular with the top and bottom surfaces of holder 102 such that retainer plate engaging surface 110 is parallel to an adjacent surface of retainer plate 36 when holder 102 is assembled with the shroud retention system and positioned within channel 80.

Retainer plate engaging surface 110 may further include protrusions 108. Protrusions 108 may be arcuate in shape and may extend outwardly from retainer plate engaging surface 110. Put differently, protrusions 108 may be circular arcs intersected by retainer plate engaging surface 110. In some embodiments, holder 102 may include two protrusions 108, where the protrusions 108 are positioned on opposite sides of through-hole 120 relative to each other. It should be understood that while embodiments shown in the accompanying figures include two protrusions 108, this disclosure is not intended to be so limited and any number of protrusions 108 may be included on retainer plate engaging surface 110. In some embodiments, as shown in FIG. 11A, retainer plate 36 may include detents 36A corresponding to protrusions 108.

In some embodiments, as shown in FIG. 11A, retainer plate 36 may include detents 36A and 36B extending inwardly from front and rear surfaces, respectively, of retainer plate 36. When the system is assembled such that retainer plate engaging surface 110 abuts retainer plate 36, as shown in FIG. 11A, protrusions 108 may extend into detents 36A. The engagement of protrusions 110 with detents 36A may inhibit retainer plate 36 from moving out of channel 80 in a direction parallel with retainer plate engaging surface 110. In some embodiments, retainer plate 36 may further include detents 36B opposite detents 36A. Protrusions extending from a rear surface of slide compressor 60 may similarly engage with detents 36B to further inhibit movement of retainer plate 36.

Though protrusions 108 are described and shown herein as arcuate in shape, it should be understood that protrusions 108 may be any other suitable shape, such as rectangular, trapezoidal, triangular, pentagonal, hexagonal, etc. The shape of protrusions 108 and corresponding detents 36A may be selected based on a desired degree of inhibition of movement of retainer plate 36. For example, protrusions 108 and detents 36A may be rectangular in shape to minimize the amount of movement of retainer plate 36. On the other hand, arcuate protrusions 108, as shown in the accompanying figures, may allow for easier disassembly of the shroud retention system.

Figure 9A:
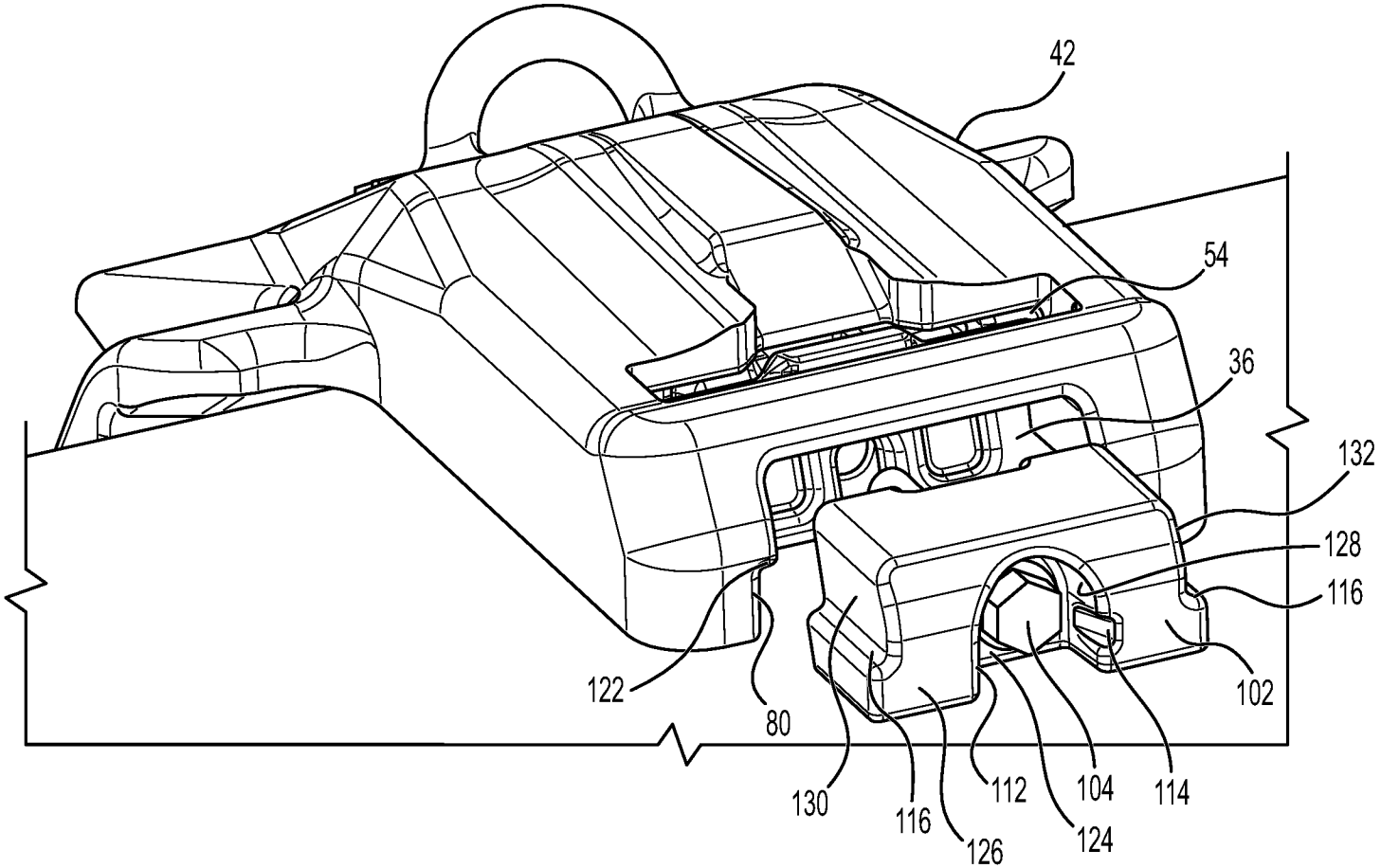
FIG. 9A is a perspective view of the shroud retention system of FIG. 2.
Figure 9B:
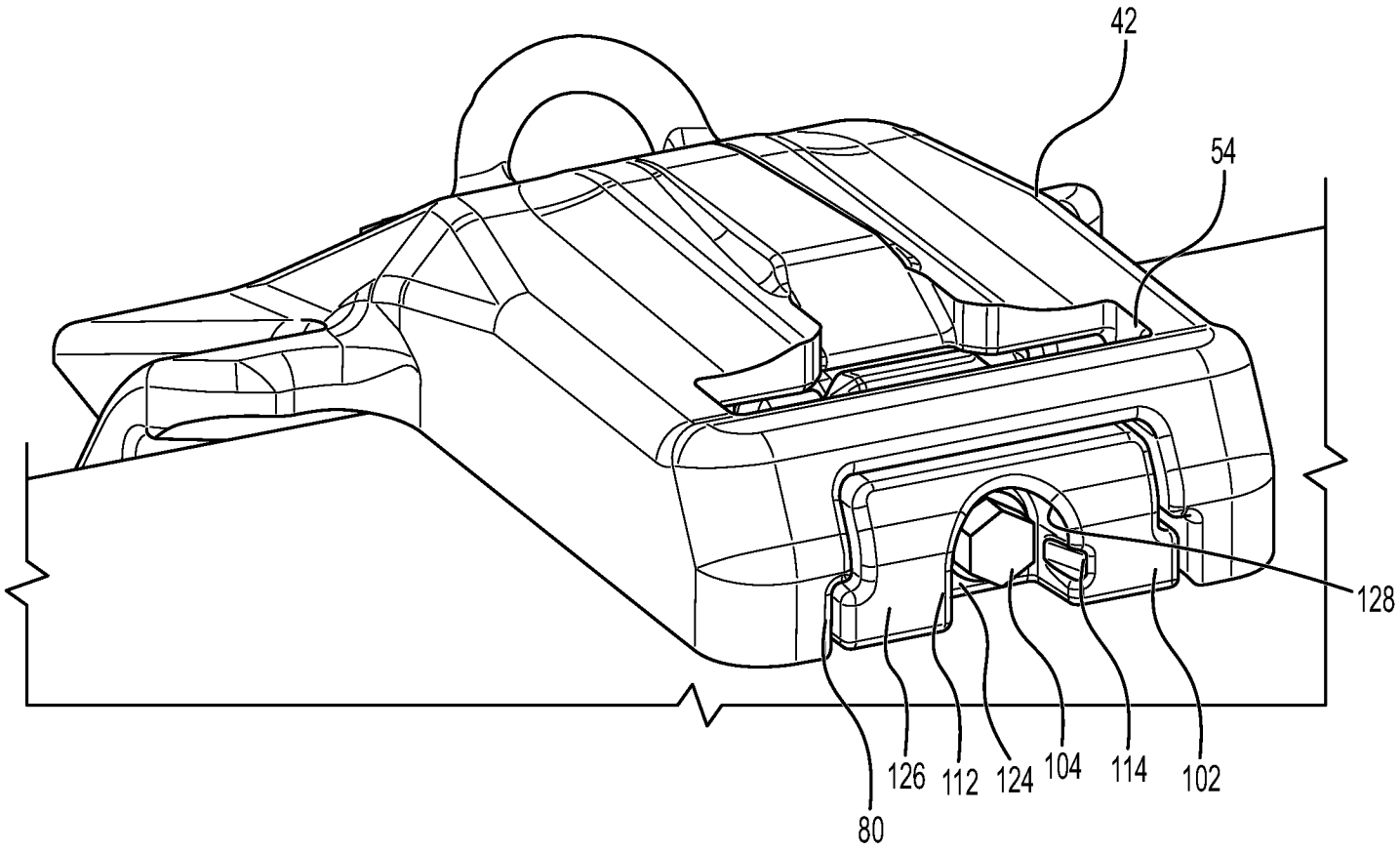
FIG. 9B is a perspective view of the shroud retention system of FIG. 2.

As shown in FIGS. 6, 7, 9A, and 9B, holder 102 may include a rearmost surface 126. In some embodiments, rear surface 124 may be recessed from rearmost surface 126. The positioning of rear surface 124 relative to rearmost surface 126 may define a recess 128 in which a head of bolt 104 is enveloped when the shroud retention system is assembled. Recess 128 may protect bolt 104 and inhibit inadvertent loosening of bolt 104 during operation of the work tool 10. In some embodiments, recess 128 may be formed so as to be only slightly larger than bolt 104. In some embodiments, as shown in FIGS. 9A and 9B, an indent 114 may formed in recess 128. Indent 114 may serve, for example, to allow room to remove bolt 104 from recess 128 when it has been loosened. Indent 114 may also serve, for example, to locate and hold a cap (not shown) used to cover bolt 104 within recess 128.

Referring to FIGS. 9A and 9B, holder 102 may further include side surfaces 130 and 132. Side surfaces may extend between top and bottom surfaces of holder 102 and/or between retainer plate engaging surface 110 and rearmost surface 126. Side surfaces 130, 132 may include shoulders 116 formed thereon. Shoulders 116 may extend outwardly from lower portions of each of side surfaces 130, 132.

Attachment portion 42 may include shoulders 122 positioned along interior surfaces of channel 80 and that correspond to shoulders 116. Shoulders 116 and 122 may collectively assist with placement of holder 102 during assembly of the shroud retention system. For example, shoulders 116 and 122 may allow for holder 102 to be inserted into channel 80 with the orientation shown in FIG. 9B and may prevent holder 102 from being inserted into channel 80 with any other orientation. Shoulders 116 and 122 may therefore promote proper engagement of retainer plate engaging surface 110 with retainer plate 36.

Figure 10A:
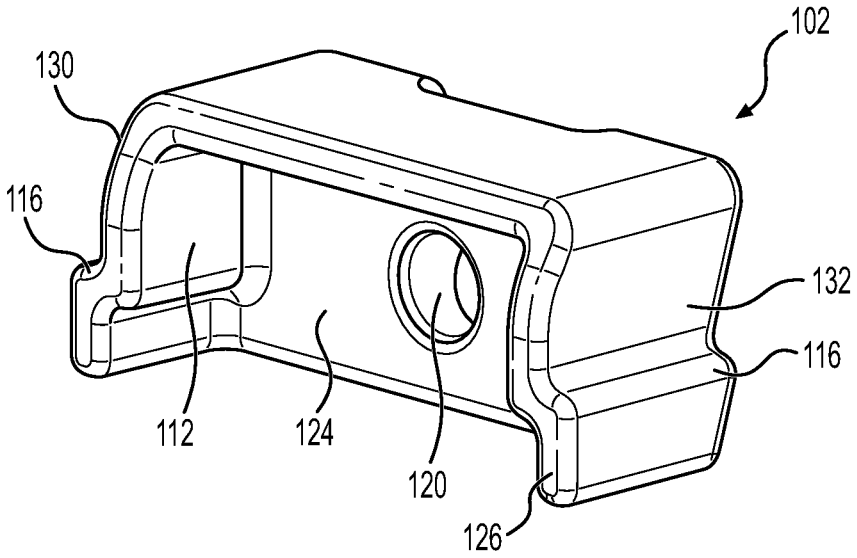
FIG. 10A is a rear perspective view of an exemplary embodiment of a holder.

Referring to FIGS. 10A and 10B, in some embodiments, holder 102 may be formed to include a wall 112 extending along a perimeter of rear surface 124. In such a configuration, rear surface 124 may occupy a substantially greater area than rearmost surface 126. Such a configuration may allow easier access to bolt 104 when bolt 104 is positioned within through-hole 120. Such a configuration may further reduce the amount of material used in fabrication of holder 102.

Through-hole 120 may positioned at a midpoint between side surfaces 130, 132. Additionally, an axis of through-hole 120 may be parallel with top and bottom surfaces of holder 102 and/or side surfaces 130, 132, such that when holder 102 is inserted into channel 80, as shown in FIGS. 5 and 7, bolt 104 may extend toward and engage with nut 62.

Holder 102 may further include a notch surface 118. Notch surface 118 may intersect surface 110 and a top surface of holder 102 and may be positioned above through-hole 120. Notch surface 118 may provide clearance for a pry bar to be inserted into notch 224 (shown in FIG. 4). When inserted into notch 224, a pry bar may be used to pry retainer plate 36 out of opening 54, as described in greater detailed hereinafter with reference to FIG. 13.

Figure 11B:
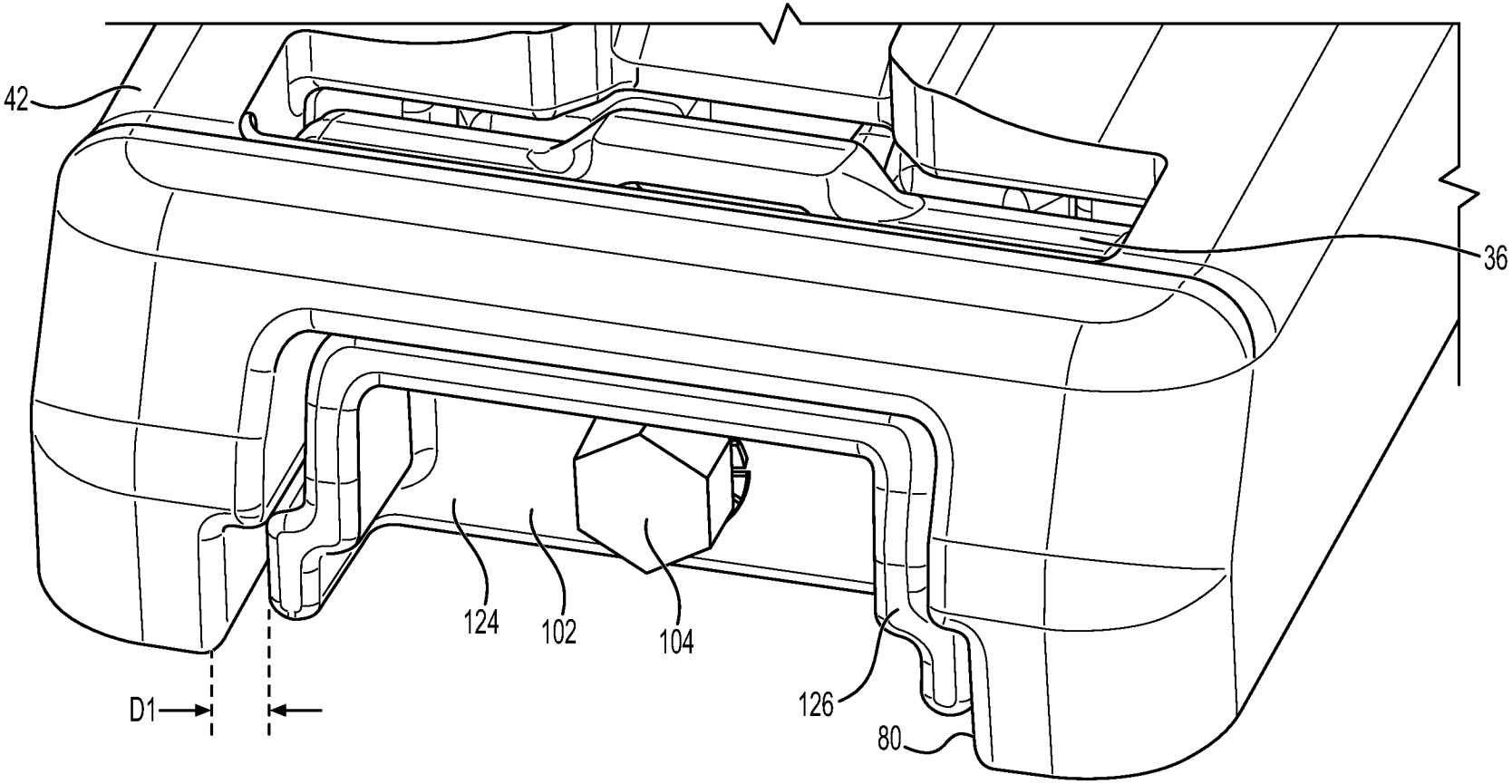
FIG. 11B is a perspective view of the shroud retention system of FIG. 11A.

Referring to FIGS. 11A and 11B, in some embodiments, the dimensions of holder 102 may be selected for a clearance fit between holder 102 and channel 80. For example, holder 102 may be sized such that a distance "$D_1$" exists between exterior surfaces of holder 102 and interior surfaces of channel 80. $D_1$ may be any suitable value, such as 0.1 mm, 1 mm, 10 mm, 25 mm, or any other value. The value of $D_1$ may be selected, for example, to provide maximum clearance between holder 102 and channel 80 while only allowing holder 102 to be inserted in the orientation shown in FIGS. 9A and 9B due to shoulders 116 and 122. In some embodiments, $D_1$ may be constant at the interface between exterior surfaces of holder 102 and interior surfaces of channel 80. In some embodiments, $D_1$ may vary at the interface between exterior surfaces of holder 102 and interior surfaces of channel 80. $D_1$ may generally be selected for ease of insertion of holder 102 into channel 80.

Additionally, as shown in FIG. 11A, holder 102 may be set back from a rear surface of attachment portion 42 by a distance "$D_2$" when the shroud retention system is assembled. $D_2$ may be any suitable value, such as 0.1 mm, 1 mm, 10 mm, or any other value. In some embodiments, $D_2$ may be larger than $D_1$. $D_2$ may be selected such that, when the shroud retention system is assembled with holder 102 in channel 80, a cap (not shown) may be inserted over holder 102 to prevent the accumulation of soil and/or other debris in channel 80 and/or on holder 102.

Figure 12A:
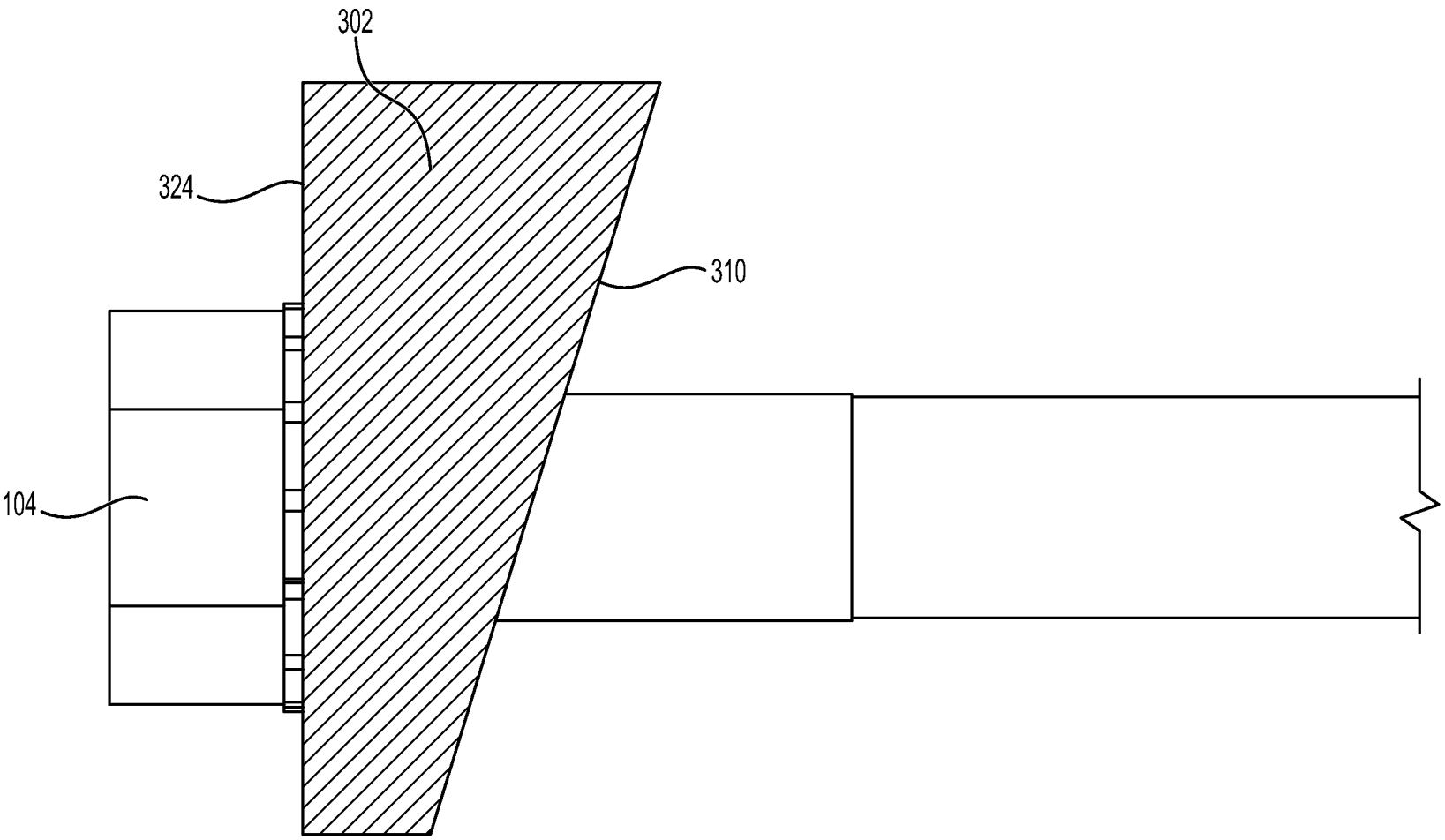
FIG. 12A is a side view of an exemplary embodiment of a holder and a bolt.
Figure 12B:
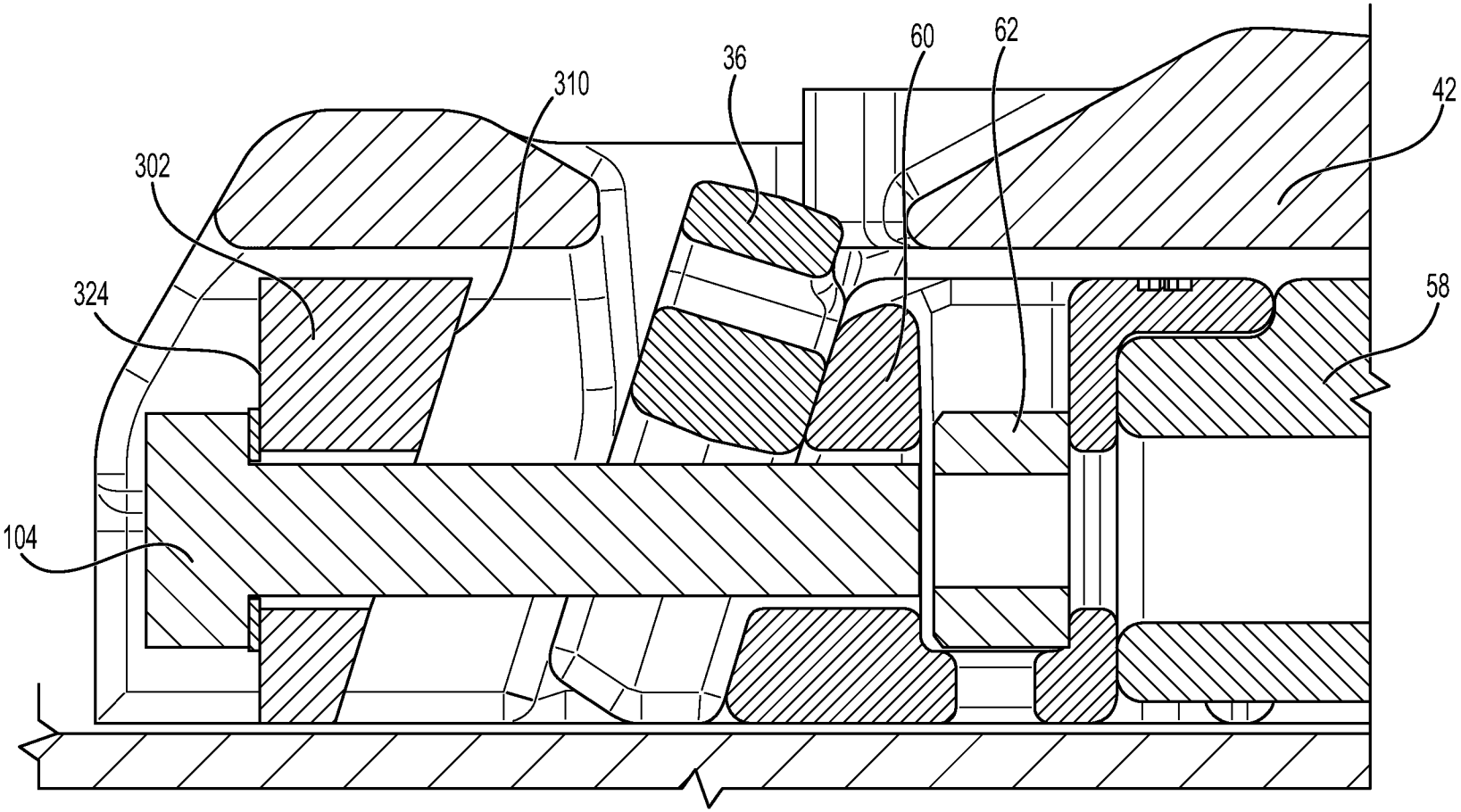
FIG. 12B is a cross-sectional side view of an exemplary embodiment of a shroud retention system.

An alternative embodiment of a holder 302 in accordance with the present disclosure is shown in FIGS. 12A and 12B. In the alternative embodiment, holder 302 may have a simple trapezoidal cross-section, with a retainer plate engaging surface 310 and a rear surface 324 opposite retainer plate engaging surface 310. Retainer plate engaging surface 310 may be inclined relative to rear surface 324. As shown in FIG. 12B, holder 302 may be inserted into channel 80 of attachment portion 42 in the same manner as holder 102. Bolt 104 may extend through holder 302 into nut 62 and may be tightened during assembly until retainer plate engaging surface 310 abuts retainer plate 36 and applies a desired force to retainer plate 36. Holder 302 may either include or omit protrusions positioned on retainer plate engaging surface 310.

INDUSTRIAL APPLICABILITY

The disclosed aspects of the holder of the present disclosure may be used with various earth-working machines, such as hydraulic excavators, cable shovels, wheel loaders, front shovels, draglines, and bulldozers. Specifically, the shroud retention system including the holder may be used to connect shrouds to work tools of these machines to help protect the work tool edges against wear. A method of retaining shroud 22 on work tool 10 using holder 102 is described hereinafter.

Figure 13:
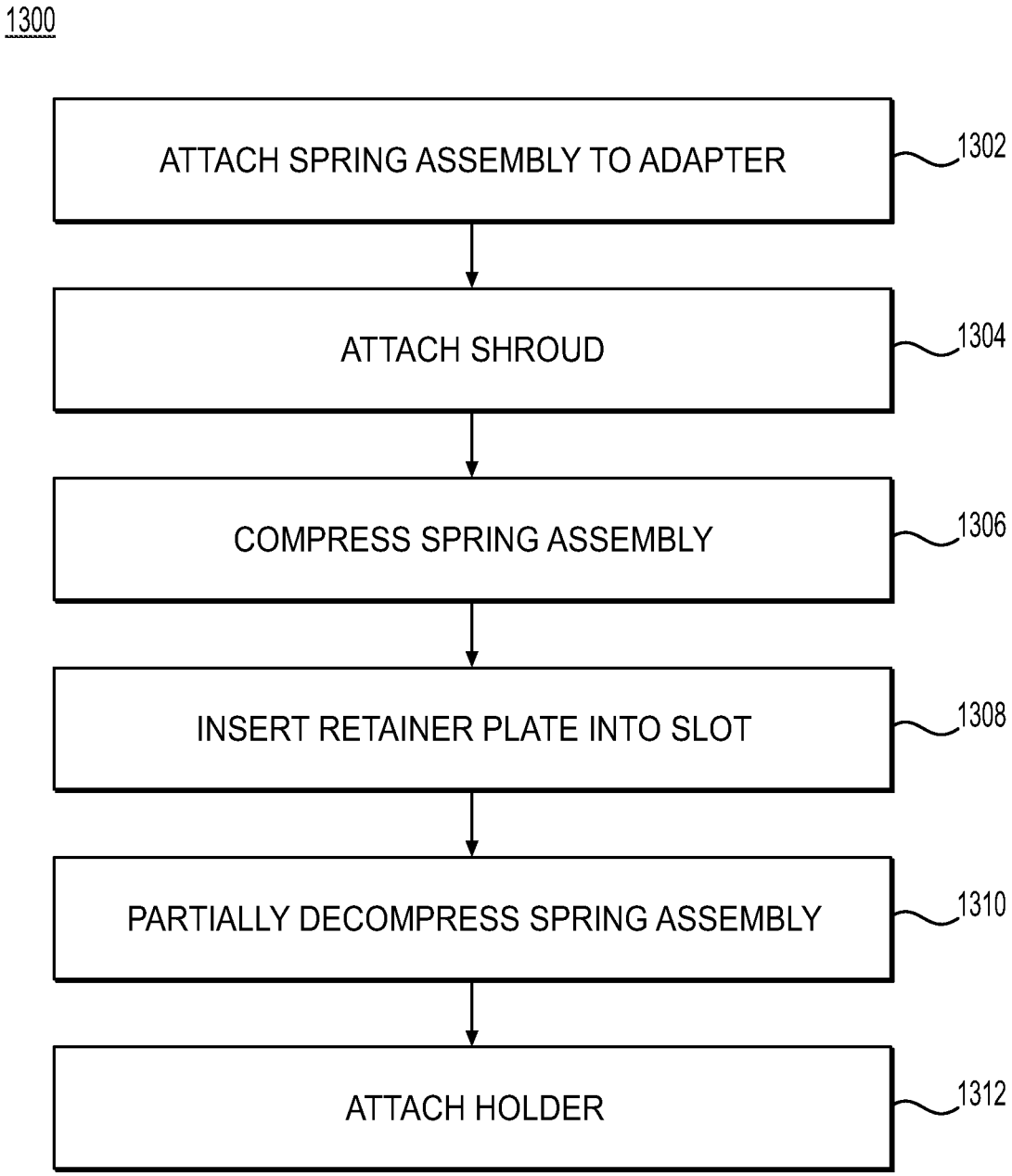
FIG. 13 is a flowchart of an exemplary method of attaching a shroud to a work tool using a holder.

FIG. 13 illustrates a method 1300 of retaining shroud 22 on work tool 10. Method 1300 may include a step of attaching spring assembly 34 to adapter 32 (Step 1302). Slide compressor 60 may be slidably attached to spring damper 58.

Method 1300 may include a step of attaching shroud 22 (Step 1304). Attachment portion 42 of shroud 22 may be positioned and pushed rearward toward edge 18 so that adapter 32 and spring assembly 34 may be slidably received in channel 80 of attachment portion 42 of shroud 22.

Method 1300 may include a step of compressing spring assembly 34 (Step 1306). To compress spring assembly 34, bolt 38 may be inserted through holes 52, 56, 64, 66 of shroud 22, adapter 32, spring damper 58, and slide compressor 60, respectively, so that bolt 38 engages with threads of nut 62 in slide compressor 60. Turning bolt 38 may cause slide compressor 60 to slidably move towards adapter 32, compressing spring damper 58. Bolt 38 may be turned until opening 54 in attachment portion 42 of shroud 22 is located rearward of slide compressor 60.

Method 1300 may include a step of inserting retainer plate 36 into opening 54 (Step 1308). Retainer plate 36 may be pushed in through opening 54 until a bottom surface of retainer plate 36 abuts an upper surface of edge 18. Retainer plate 36 may be in an unlocked position when inserted in this manner through opening 54 because it may be possible to pull retainer plate 36 out of opening 54.

Method 1300 may include a step of partially decompressing spring assembly 34 (Step 1310). To partially decompress spring assembly 34, bolt 38 may be turned to loosen bolt 38 from nut 62. Turning bolt 38 in this manner may allow slide compressor 60 to move away from adapter 32, decompressing spring damper 58. As bolt 38 is turned to decompress spring assembly 34, spring damper 58 may exert a biasing force on slide compressor 60 pushing slide compressor 60 away from adapter 32. The biasing force of spring damper 58 may cause slide compressor 60 to push retainer plate 36 so that retainer plate 36 may be tilted into its locked position. The biasing force of spring damper 58 and the angle of inclination of the rear surface of slide compressor 60 may urge retainer plate 36 against interior surfaces of attachment portion 42. When spring damper 58 is fully decompressed, bolt 38 may be removed from nut 62 and the remainder of the assembly.

Method 1300 may include a step of attaching holder 102. Once retainer plate 36 is in its locked position, holder 102 may first be aligned with channel 80 such that shoulders 116 align with shoulders 122. Holder 102 may then be inserted into channel 80 rearwardly of retainer plate 36. Holder 102 may be inserted until retainer plate engaging surface 110 abuts retainer plate 36. Once retainer plate engaging surface 110 abuts retainer plate 36, bolt 104 may be inserted through washer 106, through-hole 120, slot 208, and hole 66 and rotated until a thread portion of bolt 104 engages with nut 62. Because bolt 38 has been removed from nut 62, nut 62 may be repurposed to engage with bolt 104. Bolt 104 may then be tightened until a desired force is applied by bolt 104 and washer 106 to rear surface 124.

Advantageously, bolt 104 may engage with and be secured by nut 62, which is also used with bolt 38 to compress spring damper 58. By utilizing nut 62 for multiple functions, an overall number of components of the shroud retention system may be reduced.

To remove shroud 22 from work tool 10, bolt 104 may be loosened and disengaged from nut 62. Bolt 104 may then be removed from hole 66, slot 208, through-hole 120 and washer 106. Holder 102 may then be removed from channel 80. A pry bar may be inserted through opening 54 to push a front surface of retainer plate 36 rearward so that retainer plate 36 may disengage from interior surfaces of attachment portion 42. The pry bar may also be used to separate holder 102 from retainer plate 36, if necessary. The pry bar may then be inserted into slot 224 in retainer plate 36 to pull retainer plate 36 out of opening 54. Once retainer plate 36 has been removed, shroud 22 may be slidably disengaged from slide compressor 60 and adapter 32 by pulling shroud 22 towards shroud proximal end 70 and away from edge 18 of work tool 10.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A shroud retention system comprising:

a retainer plate holder including:

a top surface;

a bottom surface parallel to the top surface;

a retainer plate engaging surface extending between the bottom surface and the top surface, wherein the retainer plate engaging surface is inclined relative to a plane perpendicular to the top surface;

a rear surface opposite the retainer plate engaging surface along an axial direction extending between the rear surface and the retainer plate engaging surface;

a through-hole intersecting the retainer plate engaging surface and the rear surface; and one or more protrusions extending away from the retainer plate engaging surface at least partially in the axial direction.

2. The shroud retention system of claim 1, wherein the one or more protrusions are circular arcs intersected by the retainer plate engaging surface.

3. The shroud retention system of claim 1, wherein the one or more protrusions include a first protrusion and a second protrusion, the first protrusion and the second protrusion being positioned on opposite sides of the through-hole.

4. The shroud retention system of claim 1, wherein the retainer plate holder further includes:

a first side surface extending between the bottom surface and the top surface, the first side surface being parallel to a through-hole axis of the through-hole; and a first shoulder extending outwardly from a lower portion of the first side surface.

5. The shroud retention system of claim 4, wherein the retainer plate holder further includes:

a second side surface opposite the first side surface, the second side surface being parallel to the through-hole axis of the through-hole; and a second shoulder extending outwardly from a lower portion of the second side surface.

6. The shroud retention system of claim 1, wherein the retainer plate holder further includes:

a notch surface intersecting the top surface and the retainer plate engaging surface, the notch surface being positioned above the through-hole.

7. The shroud retention system of claim 1, further comprising:

an adapter fixed to a work tool;

a compressor block coupled to the adapter via a spring damper, the compressor block including a compressor front surface and a compressor rear surface opposite the compressor front surface; and a retainer plate positioned to engaged with the compressor rear surface and maintain a position of the compressor block relative to the adapter.

8. The shroud retention system of claim 1, wherein the top surface and the bottom surface extend from the retainer plate engaging surface beyond the rear surface such that the rear surface is recessed relative to a rearmost portion of the retainer plate holder.

9. The shroud retention system of claim 1, wherein the retainer plate holder further includes:

a first side surface extending between the bottom surface and the top surface, the first side surface being parallel to a through-hole axis; and a second side surface opposite the first side surface, the second side surface being parallel to the through-hole axis;

wherein each of the first side surface, second side surface, and top surface extend rearward from the retainer plate engaging surface beyond the rear surface such that the rear surface is recessed relative to a rearmost portion of the retainer plate holder.

10. A shroud retention system comprising:

a holder including:

a top surface;

a bottom surface parallel to the top surface;

a retainer plate engaging surface extending from the bottom surface to the top surface and including one or more protrusions extending from the retainer plate engaging surface, wherein the retainer plate engaging surface is inclined relative to a plane perpendicular to the top surface; and a rear surface opposite the retainer plate engaging surface;

wherein upon application of a force against the rear surface, the one or more protrusions of the retainer plate engaging surface are configured to engage with a retainer plate and inhibit movement of the retainer plate through a plane parallel with the retainer plate engaging surface.

11. The shroud retention system of claim 10, wherein the holder further includes:

a through-hole intersecting the retainer plate engaging surface and the rear surface, wherein the through-hole is configured to receive a bolt for applying the force against the rear surface.

12. The shroud retention system of claim 10, further comprising:

an adapter fixed to a work tool; and a compressor block coupled to the adapter via a spring damper, the compressor block including a compressor front surface and a compressor rear surface opposite the compressor front surface; and wherein the retainer plate is positioned to engaged with the compressor rear surface and maintain a position of the compressor block relative to the adapter.

13. The shroud retention system of claim 10, wherein the protrusions are arcuate.

14. The shroud retention system of claim 10, wherein the holder further includes:

a first side surface extending between the bottom surface and the top surface; and a first shoulder extending outwardly from a lower portion of the first side surface.

15. The shroud retention system of claim 14, wherein the holder further includes:

a second side surface opposite the first side surface; and a second shoulder extending outwardly from a lower portion of the second side surface.

16. A shroud retention system, comprising:

a compressor block including a compressor front surface, a compressor rear surface opposite the compressor front surface, and a hole extending into the compressor block from the compressor rear surface, wherein the compressor rear surface is inclined relative to the compressor front surface;

a retainer plate including a retainer front surface, a retainer rear surface opposite and substantially parallel to the retainer front surface, and a first through-hole extending from the retainer front surface to the retainer rear surface, wherein the retainer plate is positioned such that the retainer front surface engages with the compressor rear surface;

a retainer plate holder including a retainer plate engaging surface, a rear surface opposite the retainer plate engaging surface, and a second through-hole extending from the retainer plate engaging surface to the rear surface, wherein the retainer plate engaging surface is inclined relative to the rear surface; and a bolt extending through the first through-hole and second through-hole and secured within the compressor block, wherein a compressive force applied by the bolt causes the retainer plate engaging surface to engage with a retainer plate and inhibit movement of the retainer plate through a plane parallel with the retainer plate engaging surface, wherein the retainer plate rear surface includes a first set of one or more detents, wherein the retainer plate engaging surface includes one or more protrusions, and wherein the one or more protrusions engage the first set of one or more detents to inhibit movement of the retainer plate through the plane parallel with the retainer plate engaging surface.

17. The shroud retention system of claim 16, further comprising:

a work tool; and a shroud, wherein the shroud is coupled to the work tool by the compressor block, retainer plate, retainer plate holder, and bolt.

18. The shroud retention system of claim 16, wherein the first through-hole extends along an axis, and wherein the one or more protrusions extend in a direction generally parallel to the axis.

19. The shroud retention system of claim 18, wherein:

the retainer plate front surface includes a second set of one or more arcuate detents;

the compressor rear surface includes a second set of one or more arcuate protrusions; and the second set of one or more arcuate protrusions engage the second set of one or more arcuate detents to inhibit movement of the retainer plate through the plane parallel with the retainer plate engaging surface.

20. The shroud retention system of claim 16, wherein:

the retainer plate holder further includes:

a first side surface perpendicular to the rear surface and parallel to an axis of the first through-hole;

a first shoulder extending outwardly from a lower portion of the first side surface;

a second side surface opposite the first side surface and parallel thereto; and a second shoulder extending outwardly from a lower portion of the second side surface.

* * * * *